US007869606B2

(12) United States Patent
Fichtl et al.

(10) Patent No.: US 7,869,606 B2
(45) Date of Patent: Jan. 11, 2011

(54) AUTOMATICALLY MODIFIABLE HEARING AID

(75) Inventors: Elmar Fichtl, Oetwil am See (CH); Michael Boretzki, Rüti (CH); Hilmar Meier, Zürich (CH)

(73) Assignee: Phonak AG, Stafa (CH)

( * ) Notice: Subject to any disclaimer, the term of this patent is extended or adjusted under 35 U.S.C. 154(b) by 1233 days.

(21) Appl. No.: 11/392,174

(22) Filed: Mar. 29, 2006

(65) Prior Publication Data

US 2007/0237346 A1 Oct. 11, 2007

(51) Int. Cl.
*H04R 25/00* (2006.01)

(52) U.S. Cl. ..... 381/60; 381/314

(58) Field of Classification Search ..... 381/60, 381/314

See application file for complete search history.

(56) References Cited

U.S. PATENT DOCUMENTS 4,972,487 A 11/1990 Mangold
5,604,812 A 2/1997 Meyer
6,229,900 B1 5/2001 Leenen
2005/0129262 A1 6/2005 Dillon
2005/0208331 A1 9/2005 Maeda
2006/0222194 A1 * 10/2006 Bramslow et al. ..... 381/314

FOREIGN PATENT DOCUMENTS

EP 0681411 A1 11/1995
EP 1 414 271 A2 1/2004
EP 1414271 A2 4/2004
EP 1453357 A2 9/2005

* cited by examiner

*Primary Examiner*—Brian Ensey
(74) *Attorney, Agent, or Firm*—Pearne & Gordon LLP

(57) ABSTRACT

For modifying or adapting at least one basic hearing aid setting such as volume, low/high frequency balance etc., it is suggested that at particular time intervals at least one current user-selected setting entered on the hearing aid is registered and combined or linked with the existing basic setting in or on the hearing aid by means of a predefined algorithm in order to arrive at a new basic setting and to store same in or on the hearing aid. The current user setting is acquired for instance in sound-specific fashion, i.e. with reference to a specific registered sound category or at least one hearing-related ambient parameter, and is linked with the corresponding, associated sound-specific basic setting in order to arrive at the new sound-specific basic setting.

15 Claims, 3 Drawing Sheets

AUTOMATICALLY MODIFIABLE HEARING AID

BACKROUND OF THE INVENTION

This invention relates to a method for automatically modifying individual hearing-aid settings and to a hearing aid capable of automatically adjusting said settings to the individual needs of a user.

Nowadays, hearing aids are usually fitted by an acoustician. That process, however, can only to a certain limit take into account the natural as well as individual hearing environment of the hearing-aid wearer. While there have been approaches using natural sound material in the fitting process, an adaptation to the individual requirements of the hearing-aid wearer is possible to a limited extent only.

A true test of the fitting can only be made in the actual surroundings of the hearing-aid wearer since it is only there that it can be determined whether the settings made by the acoustician meet the requirements. If that is not the case, the hearing-aid wearer has to go back to the acoustician who will try to identify the problem concerned—which requires the hearing-aid wearer's ability to adequately describe the situation—and to solve it, which is difficult in the absence of the sound material needed for measuring the success.

While the hearing-aid wearer's desired optimization is already being quantified by logging location-specific hearing-aid and utilization data, one still has to see the acoustician for the appropriate modification of the settings. Such modification and the validation of the modification take place at different times.

This inefficient cycle, from the fitting to the investigation of the existing situation, determination of the necessary improvements and renewed adjustment of the settings could be cut and shortened if it were possible for the hearing-aid wearer to retain the modification i.e. adjustments made by him in his daily hearing routine. No one knows better than the hearing-aid wearer himself what his preferences are in terms of his auditory environment and how best to find the settings among those available in the hearing aid that he wants to use. If the hearing aid permanently assimilates the modifications i.e. adjustments made by him, he can promptly verify the new setting and perhaps optimize it further without multiple "detours" via the acoustician.

There already exist several approaches describing an improvement of the fitting strategy referred to above through the acquisition and storage of various data in the hearing aid itself.

U.S. Pat. No. 5,604,812 describes a hearing aid which, by means of stored fuzzy user entries and of the results of an input signal analysis using a neural network, determines the satisfactory settings of the hearing aid.

U.S. Pat. No. 4,972,487 describes a hearing aid with an integrated or attached data logging module by means of which it is possible to use the settings, modified on the basis of the user's inputs, for the fine-tuning process. Yet the modified settings will not become the new parameters until they are specifically programmed into the hearing aid during another visit to the acoustician.

U.S. Pat. No. 6,229,900 describes a combination of a hearing aid and an external device which latter is intended to compute from stored parameters, including user inputs, new settings for the hearing aid during its operation and to transfer these values back into the hearing aid.

US patent application 2005/0129262 describes a hearing aid which, based on user inputs, adjusts the settings to the respectively prevailing acoustic environment. The hearing-aid wearer's preferred settings are stored in lists with a limited number of entries. New entries are accepted for instance by the FIFO principle, or new entries cannot be accepted once the list is full. The analysis of the auditory environment only takes place during a user input, so that settings for those sound situations that would be correct under a variety of conditions tend to be missed and there is even the risk of correcting certain settings in the wrong direction.

US patent application 2004/0208331 describes a hearing aid that can be taught modifications for particular sound situations. In this case the learning steps, the learning speed and the times at which the modifications can be applied are definable. The moment the user makes a manual adjustment, the respective, current sound environment is determined and stored together with the modification. In that patent application as well, there is more emphasis on weighting the various changes than on unchanging settings of the hearing aid.

EP 1 414 271 describes, among others, a hearing aid with data logging capability, in which case the volume of the data to be stored is reduced by a statistical precalculation, thus requiring less memory space for storing complex data. Moreover, the hearing aid is capable, based on the stored parameters, of automatically modifying its settings at specific time intervals.

BRIEF SUMMARY OF THE INVENTION

To summarize the status of prior art, one finds that in part it is still necessary to follow the detour via the acoustician, that significant memory space is required for storing all necessary data, that complex algorithms are needed for the data management, and that in part the teaching results are of only moderate quality or that more or less incorrect modifications negatively affect the learning process.

In other words, it is typically necessary to provide much memory space to permit the storage of a sufficiently large number of different auditory-environment descriptions and the corresponding user inputs. Less available storage capacity means a more random and even more undifferentiated selection of possible hearing situations that would be of interest.

What is stored in the lists are strictly hearing situations that prevailed at the time of a user input, meaning that only those situations are included in which the user was presumably dissatisfied with the existing setting. It follows that the hearing aid's learning process is restricted to negative cases relative to which it will try to optimize its setting irrespective of the frequency of occurrence of the positive cases where no change is necessary. If the hearing situations in which the hearing aid fails to satisfy the user's requirements do not represent the majority of all hearing situations encountered, it may well be possible for the hearing aid settings to be adapted to rare events, compromising correct operation in most auditory situations. As a result, the user will attempt in these situations to readjust the hearing aid.

While it would in essence be possible, with enough memory space and a differentiating sensor system, to store for each given auditory situation the correspondingly discrete, preferred hearing aid setting, it would be necessary to minimize the inevitable variation of the associated user inputs.

It is therefore one objective of this present invention to introduce a method for the self-adjustment of the basic settings in a hearing aid on the basis of individual user inputs with a minimum of memory-space requirements. Another objective is to make it possible to provide for an automatic adaptation to the individual needs in differentiated fashion and preferably as a function of different sound conditions, user preferences etc. For achieving these objectives and solving the various problems mentioned above, this invention presents a method for modifying and adjusting at least one basic hearing aid setting, as well as a hearing aid which implements the method.

The idea of the invention is to avoid storing a multitude of user data which would then be used, by way of complicated algorithms, for computing basic settings on the hearing aid. Instead, according to the invention, the modification or adaptation of at least one basic setting of the hearing aid such as volume, high- and low-frequency balance etc., is obtained by registering at specific time intervals the current user-selected setting on the hearing aid and combining or linking that with the existing basic setting of the hearing aid using a predefined algorithm perhaps in order to determine or generate a new basic setting and, if necessary, to replace the old basic setting. It does not matter whether the periodically registered, current user-selected setting has changed or is identical to preceding user settings. In other words, the current user setting is not registered due to a change made by the user but is automatically captured after a typically predefined time interval. It follows that if there is no change in the user-selected setting, there is no reason for modifying the basic setting on the hearing aid.

In one form of implementation, the basic setting is modified or adjusted in each case for only one particular sound category or other hearing-related ambient parameter on the basis of the registered current user setting. Here it is possible to select the time interval according to the specific sound conditions.

In another form of implementation the basic setting may be composed of a base value and a differential value whereby, when the basic setting is combined with or linked to the value of the respectively registered current user setting, it is only the difference that will be modified or adapted while the base value remains unchanged. The advantage of this form of implementation lies in the fact that on the occasion of the next visit to the acoustician the latter can identify the change of the basic setting on the hearing aid itself and will be able, if necessary, to readjust the base-value setting.

For a better understanding the following will describe the invention in more detail with the aid of examples and, where applicable, with reference to the attached figures.

A basic differentiation is made between the various sound situations or differing hearing-related surroundings. For one, there are the surroundings in which a user finds himself, which could be a noisy environment, foreground or background noise, a quiet or silent ambience, an average noise level etc., or it could be the type of surrounding sound such as music, conversations, various every-day sounds, etc. Mixed conditions may also be registered, for example conversations with a noisy background, music in a concert hall i.e. without extraneous noise, and others.

Every time a user setting is registered, it is preceded by the detection of the prevailing sound category or hearing-related ambience, whereupon the registered current user settings can be correlated with the basic settings for the corresponding sound category.

It is also possible to differentiate between short-term and long-term preferences of, and modifications made by, the user. In the case of short-term preferences a change in the user setting can fully modify the setting of the hearing aid, also permitting extrapolation to and storage for similar hearing conditions or acoustic situations.

These temporary preferences may reflect for instance transient moods of the user and it must be possible to quickly allow for them in the basic settings. For example, a user may be more sensitive to noise early in the morning, or when he is not feeling well, for instance when he has a headache. When a user is well-rested and feels perfectly healthy, he will be less sensitive to noise, but by the same token it is entirely possible that his hearing is better, i.e. that his hearing loss has diminished somewhat. In other words, temporary preferences may have more to do with mood-influencing circumstances. On the other hand, temporary preferences may also be influenced for instance by the events of the day or by other extraneous factors.

Long-range modifications, however, require an extended acquisition period during which user-selected settings are recorded. These user settings, captured over an extended time period, define the actual basic settings of the hearing aid that need to be adjusted.

Hence, the first step before each intended adaptation process is to register the ambient conditions, allowing the measurement to be correlated with a predefined acoustic situation or predefined sound category. The sensor system of the hearing aid must be able to adequately discriminate among these conditions.

Next, for instance at sound-specific, predefined time intervals, the current user setting for volume, high/low frequency balance etc. is registered and linked with the basic setting reflecting the previously captured sound category and is combined with it by way of a pre-established algorithm.

As described above, it is possible to apply relatively significant weighting to the registered user setting, which would more strongly favor temporary preferences. Moreover, preferably in the case of temporary preferences and more heavily weighted current user settings, these are applied to, and perhaps proportionally reflected in the basic settings for, similar sound categories and acoustic conditions.

Since user inputs or the registered current user-selected settings are linked in defined fashion with the corresponding modifications of the basic hearing aid settings, it suffices for the sound categories concerned to store only the response effect of the modification based on the corresponding user input, constituting the updated, new base value for the current sound category. It follows that, compared to prior-art self-adjusting methods, enormous storage-space savings can be achieved, assuring that there will never be a situation where due to overloaded memory space current values can no longer be acquired.

But as mentioned above, it is also possible to perform long-term modifications on the hearing aid, which do not focus on temporary preferences of the user. This can be achieved by selecting an appropriate algorithm, and by suitably linking the user inputs with the modifications to be made in the hearing aid.

According to one proposed approach, the modifications are made by means of a relatively slow-working algorithm which over a period of time acquires the global and continually stable preferences of the user in particular hearing situations, deriving from these the modification of the settings for the particular hearing situations concerned. In yet another form of implementation it is even possible to virtually prevent short-term user settings from being reflected in the modification of the basic setting or base value, while only long-term tendencies are registered. It is thus possible, for example, for a first and perhaps a second strongly deviating user value to be weighted only negligibly and for the basic setting to be changed only when several identical or similar user settings that deviate from the base value are detected and registered.

In another form of implementation it is possible, in parallel with a relatively slow adaptation of the settings of the hearing aid, for the modification of a hearing situation as a result of a user input to instantaneously generate and apply a modification for similar hearing situations. Then, too, the modifications that result from the current user inputs are weighted by the algorithm to a relatively minor extent only and can therefore be quickly changed again. Based on these relatively fast-changing modifications the slower algorithm, described in the first implementation approach, is built up in a way as to register the long-term trends.

It will be evident from the above explanations that by means of the selected algorithm there are various ways in which the basic setting can be modified. Different statistical methods may be applied in the algorithm for determining from among a number of user settings the value by which the basic setting must be corrected or adjusted. Especially in connection with the aforementioned slow adaptation of the settings it will be desirable to derive from a number of registered user-selected settings the so-called weighted mean value for use in adjusting the basic setting. Of course, other methods as well, for instance of a statistical nature, may be possible and practical. Using statistical methods also permits registered short-term changes of the user settings to be ignored or almost ignored in the modification of the basic setting on the hearing aid, i.e. the effect of short-term fluctuations will be significantly reduced.

In general, the user inputs can be registered for any possible parameter. This may include simple as well as complex parameters as mentioned above, such as volume, tonal balance and the like.

BRIEF DESCRIPTION OF THE DRAWINGS

The following describes two possible examples of the novel adaptation method with reference to the attached diagrams in which

FIG. 1 is a schematic block diagram showing the adaptation of global and stable long-term preferences, whereby any data or settings produced by a user are employed for optimizing the hearing aid setting. The modification of the settings is made separately by available sound categories as described further above.

DETAILED DESCRIPTION OF THE INVENTION

Figure 1:
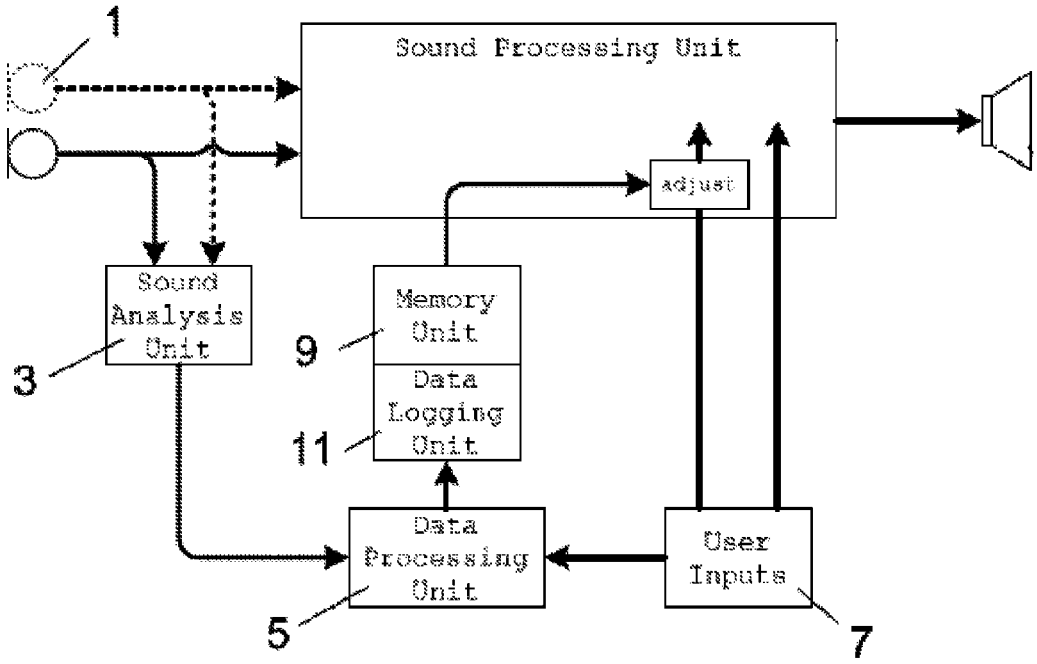
FIG. 1 is a schematic illustration of the global modification of hearing aid settings by employing stored user inputs.

At a preferably predefined logging clock rate a hearing aid registers the current settings, i.e. the status of the user controls 7, on the hearing aid. The user parameters are captured by specific sound categories, meaning that initially, by way of a microphone 1, the current sound categories or hearing-related ambient parameters are registered by a sensor system 3 and the correspondingly detected user setting on the user control 7 is transferred in sound-specific fashion to a processing unit 5. The registration of current sound categories or of the current acoustic environment entails in all cases the ability to automatically register other hearing-related ambient parameters. The processing unit 5 performs a check, as necessary, on whether the user setting detected by the user control 7 has a changed value or whether that setting has remained unchanged from those recorded earlier. The current sound-specific result can be stored, in space-saving fashion, in a memory module 9 and is available for the modification of the original sound-specific basic setting of the hearing aid. The setting of the device itself may be based on the current user input per user control 7 while the new basic setting, modified by virtue of the current, registered user input, usually has no influence on the setting of the hearing aid proper. Such effect on the basic setting of the hearing aid itself occurs for instance in time-delayed fashion and can be initiated by a corresponding action of the user, for instance by switching the hearing aid on, or by an explicit command to activate the new settings, or during a so-called updating action for activating the new settings of the hearing aid. This time-delayed effect of the modified new basic settings on the actual hearing aid settings serves to avoid for the user perceptible fluctuations of the emitted signals during the operation. As an alternative, the user also has an opportunity to restore i.e. reset the original basic settings.

On the other hand, however, in sound-specific terms only one single new basic setting, or perhaps a new base value, need be stored in the hearing aid, whereby only few parameters are kept in the memory module 9, thus minimizing the memory-space requirements.

In the event that an acoustician wants to check what changes have been made to the basic setting, the value of the basic setting is preferably composed of a base value and a differential value. Changes to the basic settings on the hearing aid leave the base value unchanged, whereas the value of the difference between base value and basic setting is modified as a function of the recorded user input. This enables the acoustician during his next check to promptly determine what changes need to be made to the base value as a result of the registered user inputs. The modifications may be performed for instance by means of a so-called fitting software program designed to modify the existing basic settings. When at defined time intervals the user unit registers user-selected settings, the acoustician can integrate these in the fitting software with the original, existing sound-specific settings which, representing current hearing aid settings, can for instance be displayed and then stored in the memory module 9. As mentioned above, provisions can be made for the base value to remain unchanged while the new basic setting is determined as a function of the new differential value. During the visit to the acoustician the latter will have the ability to cancel the modifications made in the fitting software and to restore the original settings that may result for instance from the base value. Otherwise the modified, new sound-specific settings when next stored in the hearing aid, will be written into the non-volatile memory (NVM) of the hearing aid as its fixed, new basic setting. In the fitting software the acoustician can deactivate or reactivate various functionalities of the hearing aid. The fitting software also allows the acoustician to adjust, modify or change the algorithm in the hearing aid, that algorithm being responsible for changing the basic settings in the hearing aid. Of course, it is also possible to provide the hearing-aid wearer with fitting software by means of which the user himself can make adjustments to the algorithm. Such fitting software is preferably stored in a device separate from the hearing aid, such as a remote control unit for operating the hearing aid, a data processing unit such as a PC, or a notebook to which the hearing aid can be connected for instance via a USB port. And, of course, the algorithm can be modified by means of the fitting software wirelessly from a notebook or other electronic device.

Figure 2:
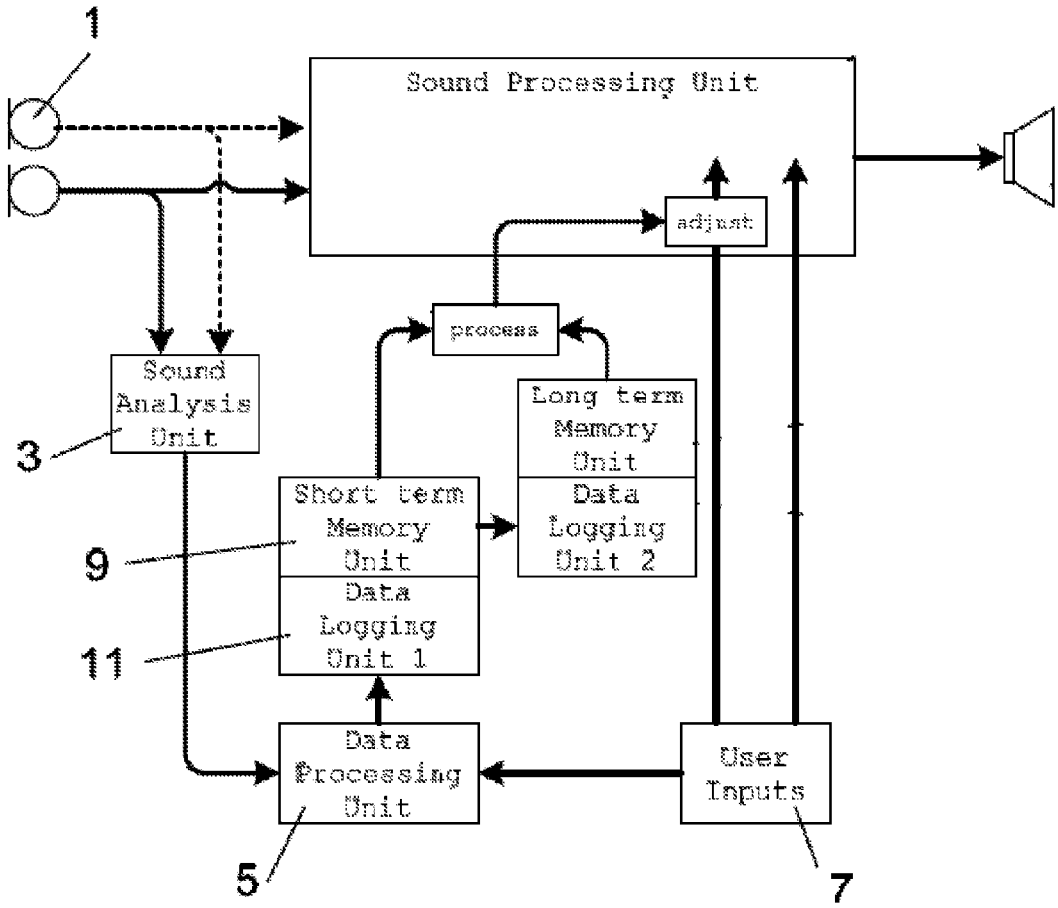
FIG. 2 is a schematic illustration of another implementation example of global and short-term modifications of hearing aid settings by employing stored user inputs.

FIG. 2 illustrates a modified adaptation option on a hearing aid that allows for the accommodation of changed user inputs. Here as well, for instance by means of a microphone 1 and a sensor system 3, the corresponding sound category is identified in which the basic setting on the hearing aid is to be changed. This, of course, can be done only when the user control 7 has registered changed sound-specific, current user settings. The adaptation of the basic setting based on the registered user input again takes place in a processing unit 5 and the resulting new base values are fed to a memory module 9 via a logging unit 11.

In FIG. 2, departing from the method illustrated in FIG. 1, the processing unit 5 adjusts not only the base value associated with the specific sound category registered in response to the user input, but also the basic settings for similar acoustic situations or sound categories. As mentioned above, modern hearing aids discriminate between different acoustic situations to each of which they adapt the operating mode. For example, it is generally possible to define four different sound categories.

Reverting to the processing unit 5 in FIG. 2, an adaptation of the setting within one sound category will lead to a proportionate modification in other sound categories as well.

As a result of this so-called instantaneous adjustment of the settings, modifications made in one sound category will lead to a modification of the basic setting in other, similar sound categories, avoiding transients during the changeover from one sound category to another. The modification can be made in linear fashion or along a sufficiently perceptible function. It is also possible to set it in a way whereby, as mentioned above, the modification to be made in the current sound category must always be applied at 100% while in the other, similar sound categories the modification is weighted as a function of the degree of similarity.

A sound modification can thus be weighted more heavily when its similarity to the sound category being modified is substantial, that sound category occurs only rarely, or the user inputs vary little.

Figure 3:
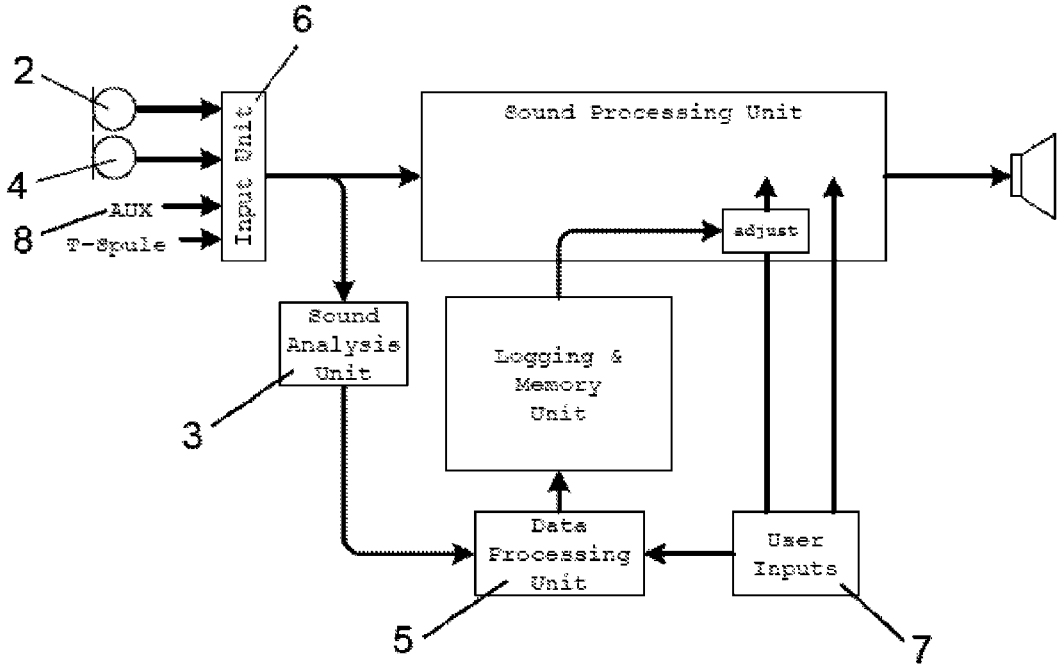
FIG. 3 shows in schematic form a method, analogous to that per FIG. 2, for the modification of hearing aid settings.

Finally, FIG. 3 is a diagrammatic illustration of an adaptation method similar to that in FIG. 2 except that it schematically depicts, in particular, a modified input unit 6. This input unit 6 may be equipped with one or several microphones 2 and 4, it may have a sound input port allowing for instance the connection to an MP3 player or to a telephone circuit, or for instance a so-called auxiliary port 8 to which some device that generates audio or other signals can be connected.

Of course, the description of the method with reference to FIGS. 1 to 3 represents examples only, serving to better explain the concept of this invention. And, of course, any other adaptation mechanisms may be used for adapting the basic settings of a hearing aid to the short-term, medium-term or long-term requirements of a user. One significant difference between this concept and the various adaptive methods of prior art lies in the fact that the current user settings are registered not only if and when they are changed by the user but also when they remain unchanged. This is accomplished by scanning and registering the current user settings at predefined time intervals.

Another advantage over prior art lies in the fact that not all of the different values such as basic settings, base values and detected user settings are routinely stored in memory but that for instance the applicable basic settings, after having been modified by the value of the registered user setting, are newly saved and the corresponding old values are deleted and replaced by the new values. Thus, there is no increase in the volume of stored values and no danger of overloading the memory to the point where new, current user settings can no longer be acquired.

The invention claimed is:

1. Method for modifying and adjusting at least one basic hearing aid setting, characterized in that, at certain time intervals, at least one current user-selected setting on the device is registered with an existing basic setting in the hearing aid by means of a predefined algorithm in order to arrive at a new basic setting and to store that in the hearing aid.

2. Method as in claim 1, characterized in that on the basis of the current user-selected setting, the new basic setting is in each case modified or adapted for only one particular sound category in sound-specific fashion or for one hearing-related ambient parameter.

3. Method as in claim 1, characterized in that the new basic setting, modified in sound-specific fashion, is stored in a memory module on the hearing aid, whereby, as necessary, the existing basic setting is replaced or deleted from the memory.

4. Method as in claim 1, characterized in that the new basic setting is composed of a base value and a differential value and that, upon linking the existing basic setting with the value of the current user-selected setting, only the differential value is changed or adjusted, leaving the base value in the hearing aid unchanged.

5. Method as in claim 1, characterized in that, initially, a specific sound category or at least one hearing-related ambient parameter is registered and that the current user-selected setting registered at the hearing aid is linked with the existing basic setting for the respective specific sound category or hearing-related ambient parameter in order to define a new sound-specific basic setting, while the basic settings for the other sound categories remain unchanged.

6. Method as in claim 1, characterized in that, initially, a specific sound category is registered and that a current sound-specific user-selected setting captured at the hearing aid is linked with the existing basic setting for the said specific sound category in order to define a new sound-specific basic setting, while changes to the existing basic settings for the other sound categories take place on a reduced scale or in such incremental fashion that the existing basic settings for similar sound categories are proportionally modified more significantly than the existing basic settings for sound categories that differ more strongly from the registered specific sound category.

7. Method as in claim 1, characterized in that registered short-term changes to the user-selected settings are only minimally reflected in the modification of the new basic setting on the hearing aid.

8. Method as in claim 1, characterized in that the user-selected settings on the hearing aid correspond to those entered by the user and that a change of the hearing aid settings due to the new basic settings will take place only when the hearing aid is reactivated, or in an updating process.

9. A hearing aid comprising:

at least one basic hearing aid setting including an existing basic setting and at least one current user-selected setting; and an algorithm configured to determine a new basic setting; wherein the algorithm registers the current user-selected setting with the existing basic setting to determine the new basic setting and the algorithm stores the new basic setting in the hearing aid.

10. Hearing aid as in claim 9, incorporating the following:

a sensor system for the detection of sound categories and the acoustic surroundings in which a user finds him/herself;

at least one input control element allowing a user to change the basic hearing aid settings;

a processing device for the sound-specific acquisition of user-selected settings and for linking the acquired sound-specific user-selected settings with sound-specific basic hearing aid settings stored in a memory module.

11. Hearing aid as in claim 10, characterized in that, stored in the processing device, software is provided for linking sound-specific basic settings of the hearing aid, stored in the memory module, with the current user-selected settings acquired by the processing unit.

12. Hearing aid as in claim 11, characterized in that the said software also permits the proportional adaptation of a basic setting for other sound categories or other hearing-related ambient parameters as a function of the new basic settings, with the basic settings for similar sound categories or ambient parameters undergoing proportionately more significant modifications than the basic settings for strongly deviating sound categories or ambient parameters.

13. Method for modifying an algorithm that is responsible for the linking of an existing basic setting in a hearing aid with at least one current user setting captured and present on the hearing aid, characterized in that the algorithm is modified by means of a fitting software that is stored in a device external to the hearing aid, with the link between the said device and the hearing aid established in a wireless fashion or via a cable connection.

14. Method as in claim 13, characterized in that the modification of the algorithm by means of fitting software is performed by an acoustician.

15. Method according to claim 13, wherein the software is stored in a remote control unit or a data processing system.

* * * * *